US012134042B2

(12) United States Patent
Chien

(10) Patent No.: US 12,134,042 B2
(45) Date of Patent: Nov. 5, 2024

(54) METHOD AND SYSTEM FOR AN INTERACTIVE PLAYER BOARD GAME

(71) Applicant: Judy Chien, New York, NY (US)

(72) Inventor: Judy Chien, New York, NY (US)

(73) Assignee: Judy Chien, New York, NY (US)

( * ) Notice: Subject to any disclaimer, the term of this patent is extended or adjusted under 35 U.S.C. 154(b) by 353 days.

(21) Appl. No.: 17/523,209

(22) Filed: Nov. 10, 2021

(65) Prior Publication Data

US 2023/0141684 A1 May 11, 2023

(51) Int. Cl.
*A63F 3/04* (2006.01)
*A63F 9/24* (2006.01)

(52) U.S. Cl.
CPC ..... *A63F 3/0415* (2013.01); *A63F 9/24* (2013.01); *A63F 2003/0418* (2013.01); *A63F 2009/2438* (2013.01); *A63F 2009/2447* (2013.01)

(58) Field of Classification Search
CPC ..... A63F 3/0415; A63F 2003/0418
USPC ..... 273/236, 240, 242, 243, 248, 268
See application file for complete search history.

(56) References Cited

U.S. PATENT DOCUMENTS 4,092,029 A * 5/1978 Jones ..... A63F 3/00 273/271
4,124,213 A * 11/1978 Kaplowitz ..... A63F 3/02 273/288
4,129,304 A * 12/1978 Mager ..... A63F 3/00157 273/288
4,679,797 A * 7/1987 Sherin ..... A63F 3/00006 273/251
5,310,346 A * 5/1994 Dillhoff ..... A63F 3/04 273/272
5,927,717 A * 7/1999 Berkovi ..... A63F 3/0415 273/271
6,089,871 A * 7/2000 Jaffe ..... A63F 3/0415 273/271
7,114,719 B2 * 10/2006 Steenstra ..... A63F 9/12 273/276
7,341,250 B2 * 3/2008 Lewis, Jr. ..... A63F 3/00 273/146
7,475,877 B2 * 1/2009 Mier ..... A63F 3/00006 273/287
7,549,641 B2 * 6/2009 Darling ..... A63F 1/00 273/292
7,950,665 B2 * 5/2011 Treloar ..... A63F 1/00 273/303
8,419,017 B1 * 4/2013 Lazare ..... A63F 3/00006 273/287

(Continued)

*Primary Examiner* — Joseph B Baldori
(74) *Attorney, Agent, or Firm* — Mohamed C. Azeez

(57) ABSTRACT

An interactive group-specific player board game method comprising the steps of drawing a grid and labeling a plurality of blocks in a sequential process from 1 to n, wherein n depends on the size of the grid, rolling a dice by each player sequentially and recording a number on the dice until each box on the grid has a unique number, establishing a set of at least 6 rules by the group-specific players, each rule corresponding to a unique action to be performed by the players, rolling the dice by at least one player, moving the number of blocks on the board game corresponding to the number on the dice, receiving the action to be performed by the player based on the unique number on the grid established by the set of rules, determining the completion of the action by the remaining group-specific players.

8 Claims, 7 Drawing Sheets

(56) References Cited

U.S. PATENT DOCUMENTS

| | | | | |
|---|---|---|---|---|
| 10,325,516 | B1 * | 6/2019 | Drymiller | A63F 3/0415 |
| 10,807,007 | B2 * | 10/2020 | Nuell | A63F 13/33 |
| 10,814,214 | B1 * | 10/2020 | Lahti | G06N 5/04 |
| 2005/0230913 | A1 * | 10/2005 | Tee | A63F 3/0415 273/243 |
| 2006/0082059 | A1 * | 4/2006 | Lee | A63F 3/00 273/243 |
| 2010/0252994 | A1 * | 10/2010 | Bancel | A63F 3/0415 273/157 R |
| 2014/0093846 | A1 * | 4/2014 | Bird | A63F 3/00529 434/167 |
| 2014/0367916 | A1 * | 12/2014 | Ranalli | A63F 3/00214 273/260 |
| 2015/0001797 | A1 * | 1/2015 | Piche | A63F 9/04 273/245 |
| 2021/0016156 | A1 * | 1/2021 | Herman | A63F 3/00006 |

* cited by examiner

| | | | | | | | |
|---|---|---|---|---|---|---|---|
| 55 | 56 | 57 | 58 | 59 | 60 | 61 | 62 | 63 |
| 54 | 53 | 52 | 51 | 50 | 49 | 48 | 47 | 46 |
| 37 | 38 | 39 | 40 | 41 | 42 | 43 | 44 | 45 |
| 36 | 35 | 34 | 33 | 32 | 31 | 30 | 29 | 28 |
| 19 | 20 | 21 | 22 | 23 | 24 | 25 | 26 | 27 |
| 18 | 17 | 16 | 15 | 14 | 13 | 12 | 11 | 10 |
| 1 | 2 | 3 | 4 | 5 | 6 | 7 | 8 | 9 |

| | | | | | | |
|---|---|---|---|---|---|---|
| 55 2 | 56 3 | 57 3 | 58 6 | 59 2 | 60 3 | 61 |
| 54 4 | 53 6 | 52 6 | 51 4 | 50 3 | 49 1 | 48 5 |
| 37 1 | 38 4 | 39 3 | 40 1 | 41 6 | 42 2 | 43 5 |
| 36 2 | 35 5 | 34 1 | 33 2 | 32 6 | 31 5 | 30 4 |
| 19 4 | 20 2 | 21 3 | 22 5 | 23 4 | 24 4 | 25 5 |
| 18 6 | 17 1 | 16 2 | 15 1 | 14 5 | 13 3 | 12 1 |
| 1 3 | 2 5 | 3 6 | 4 4 | 5 3 | 6 4 | 7 2 |

| | | | | | | |
|---|---|---|---|---|---|---|
| 62 6 | 63 1 | | | | | |
| 47 3 | 46 5 | | | | | |
| 44 4 | 45 6 | | | | | |
| 29 6 | 28 2 | | | | | |
| 26 3 | 27 5 | | | | | |
| 11 4 | 10 5 | | | | | |
| 8 5 | 9 6 | | | | | |

Fig. 2

1. Roll Again
2. Go Forward 1 space
3. Go backward 3 spaces
4. Lose next turn
5. Go backward 5 spaces
6. Go forward 2 spaces

Fig. 3A

1. Roll Again
2. Go Forward 5 space
3. Sing a song
4. Lose next turn
5. Do 10 jumping jacks
6. Eat a chocolate

Fig. 3B

METHOD AND SYSTEM FOR AN INTERACTIVE PLAYER BOARD GAME

BACKGROUND

Field of the Invention

The present invention generally relates to a method of playing a board game by group-specific players. More importantly, the rules set by the group dictate the playing of the game.

Related Art

A board game is a generic term for a game played by placing, moving, or removing pieces on a board and that utilizes a game format in which pieces are moved in particular ways on a board marked with a pattern. Examples of board games include chess, Go, and Shogi. Research involving chess, which is played by two players on a board with 64 black and white squares and 16 pieces for each player, has contributed to the theoretical development of cognitive psychology. Far from fading away in the digital age, board games are enjoying a boom time because they are social, challenging and tangible. And designers are using technology to create new ways to play.

The recent Covid-19 pandemic and the lockdown have seen an explosion of the board games like never. Board games provide a popular distraction for households looking for digital detox during lockdowns. Current trends show an uptick in interest among adults, with a global board game segment worth around $15 billion (€12.4 billion) growing more than the toy market as a whole. However, there is always a demand for more group-specific player games that increase learning and entertaining opportunities among a wide group of people.

SUMMARY

In accordance with one preferred embodiment of the invention, an interactive group-specific player board game method comprising the steps of drawing a grid and labeling a plurality of blocks in a sequential process from 1 to n, wherein n depends on the size of the grid, rolling a dice by each player sequentially and recording a number on the dice until each box on the grid has a unique number, establishing a set of at least 6 rules by the group-specific players, each rule corresponding to a unique action to be performed by the players, rolling the dice by at least one player, moving the number of blocks on the board game corresponding to the number on the dice, receiving the action to be performed by the player based on the unique number on the grid established by the set of rules, determining the completion of the action by the remaining group-specific players.

Further yet, in an embodiment of the present invention the group-specific board game further comprises of at least two players. Additionally, the first dice is rolled by the youngest player in the group, with the subsequent roll performed by the player in a clockwise direction of the youngest player.

In yet another embodiment of the invention, a dynamic board game playing system comprising of at least two players each with a body-worn/mobile device configured for capturing of at least one action of the players, a dice wherein, each side of the dice demonstrates a number of moves on the board game, a processor, an analyzing module, a non-transitory storage element coupled to the processor encoded instructions stored in the non-transitory storage element, wherein the encoded instructions when implemented by the processor, configure the system to: draw a grid and label a plurality of blocks in a sequential process from 1 to n, wherein n depends on the size of the grid; roll the dice by each player sequentially and record a number on the dice until each box on the grid has a unique number, establish a set of at least 6 rules by the group-specific players, each rule corresponding to a unique action to be performed by the players, roll the dice by at least one player; move the number of blocks on the board game corresponding to the number on the dice, receive the action to be performed by the player based on the unique number on the grid established by the set of rules, determine the action performed by the player by mapping a received input action with a pre-stored set of actions via the analyzing module and dynamically interact with the player based on a completion of the action and indicate the completion of the action on the body-worn device.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

FIG. 2 shows another perspective view of the board game grid according to aspects of the invention.

FIG. 3*a* shows sample of rules according to aspects of the invention.

FIG. 3*b* shows another perspective of the sample of rules according to aspects of the invention.

DETAILED DESCRIPTION

The present invention will now be described more fully with reference to the accompanying drawings, in which embodiments of the invention are shown. However, this disclosure should not be construed as limited to the embodiments set forth herein. Rather, these embodiments are provided so that this disclosure will be thorough and complete, and will fully convey the scope of the disclosure to those skilled in the art. Like numbers refer to like elements throughout.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but no other embodiments.

Figures 1A, 1B:
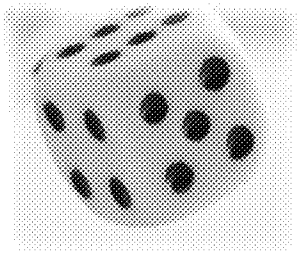
FIG. 1*a* shows board game grid according to aspects of the invention.
FIG. 1*b* shows a perspective view of a dice used to play the board game according to aspects of the invention.

Now in reference to FIG. 1A, FIG. 1B and FIG. 2, according to an embodiment of the invention an interactive group-specific player board game method comprising the steps of drawing a grid and labeling a plurality of blocks in a sequential process from 1 to n, wherein n depends on the size of the grid, rolling a dice by each player sequentially and recording a number on the dice until each block/box on the grid has a unique number. The number rolled on the dice is recorded in the center of the box. Further yet, according to an embodiment of the invention, establishing a set of at least 6 rules by the group-specific players, each rule corresponding to a unique action to be performed by the group-specific players, rolling the dice by at least one player and moving the number of blocks on the board game corresponding to the number on the dice. The player taking the turn receives the action to be performed based on the unique number on the block established by the set of rules and determining the completion of the action by the remaining group-specific players in the group.

Further yet, in an embodiment of the invention, the method of playing a group-specific board game further comprises of at least two players. The board game can be played using at least one of, but not limited to, a white board, paper, book, electronic devices including but not limited to iPad, computer, laptop, mobile communication device where a grid can be drawn. The size of the grid may vary and depend on the size of the surface the board game is played on. Additionally, the size of the grid may further be dependent on the duration of the game based on the decision of the group-specific players. Further yet, in an embodiment of the invention, the first dice is rolled by the youngest player in the group, with the subsequent roll performed by the player in a clockwise direction. Additionally, the board game may be played by any players ages 3 and above.

In an embodiment of the invention, once the gird is drawn, each of the blocks on the grid are labelled in a sequential manner from 1 to n beginning from bottom left and ending on the top right. There are two set of numbers on each of the blocks on the grid. The number on the top left designates a particular block on the grid and the number in the center of the block on the grid corresponds to the number on the dice rolled by the players in the specific group. The dice is initially rolled by the youngest player in the group with subsequent rolls performed by the players in a clockwise direction. Alternatively, the group-specific players can decide which player rolls the initial dice. For example, the initial dice is rolled by the youngest player and the subsequent roll of the dice is carried out by the player in an anti-clockwise direction. Another example would be the initial dice would be rolled by the oldest player and the subsequent roll of the dice is done by the player in a clockwise direction. In another scenario, the dice is initially rolled by the youngest player with a subsequent roll performed by a player second youngest in the group.

Further yet in an embodiment of the invention, the recording of the number on the dice is in at least one of, but not limited to top-left to bottom-right, bottom-right to top-left, bottom-left to top-right, top-right to bottom-left direction. The group-specific players decide on the direction of the recording the number on the dice in the center of the block on the grid.

In yet another preferred embodiment of the invention, before the start of playing the board game, the group-specific players choose a set of 6 rules to be included during the play of the game. Rules are generally created by, or at least agreed to, by all players before playing the game and are written down to ensure enforceability. The goal of the game is to be the first person to progress through the game path and get to the "Finish" box/block. Players roll the die on their turn and move the number of spaces that they rolled.

Now with reference to FIGS. 3A and 3B. In an embodiment of the invention, the rules may vary depending on at least one of age, gender, environment, physical and emotional abilities of the players. For example, the as seen in FIG. 3A and FIG. 3B, if the players in a group are senior adults the rules may be according to FIG. 3A "1. Roll Again, 2. Go Forward 1 space, 3. Go backward 3 spaces, 4. Lose next turn, 5. Go backward 5 spaces, 6. Go forward 2 spaces" where no physical activity is required. Alternatively, if the players in the group are teenagers or young kinds, the rules may be according to FIG. 3B, "1. Roll Again, 2. Go Forward 5 space, 3. Sing a song, 4. Lose next turn, 5. Do 10 jumping jacks, 6. Eat a chocolate".

Players roll the die on their turn and move the number of spaces on the gird. Additionally in an embodiment of the invention, the move by the player may be modified by a block on the grid that they have landed on, a card or move played by another player, by landing on the same space as another player, by the custom rules, or by the rule that their roll specifies they land on. Players perform the "action" when they land on it, and follow the rules defined on their rule sheet.

Alternatively, in an embodiment of the invention, during the game play, the game board is dynamic and may change in several ways. For example, if a player lands on a block to be swapped, that player can choose to swap the location of any two unoccupied blocks on the board, except for the "Start" or "Finish" blocks. In doing so, the players can try to change the game board to their advantage by moving a block ahead of them that they wish to land on or moving a block in front of another player that they wish the other player to land on. If a player lands on a "Reverse" block, they may choose to reverse over any block on the game board that is unoccupied, as long as it doesn't interrupt the path of the game (such as by turning over a turn block to break the game path). In doing so, a player can turn over a "Lose a Turn" to expose "Extra Turn," and try to increase their chance of gaining an extra turn instead of losing a turn.

The rules are check-off options which affect game play elements such as which player goes first, or whether an exact roll on the dice is required to land on the "Finish" tile. Players can also define what happens when someone lands on a particular block on the grid. When a player lands on a block on the grid during play, they must perform the action specified by the rule corresponding to the center number on the grid. This can be a directly game-related action such as "Move Back 5" or a more socially-focused action, such as "Sing a song as off key as possible and get an extra turn."

In yet another embodiment of the invention, at least one dice is rolled to make the rules of the game. Alternatively, more than one dice may be used to make at least one rule. For example, if 10 players are playing the game, 2 dice may be used to set at least 12 rules. Another example would be where the game may be played with 14 players and 2 dice may be used to make at least 10 rules. The number of dice used to make the rules may vary and may also depend on the number of players playing the game. Additionally, at least one of, but not limited to, a deck of cards or random number generator on any mobile communication device for example, cell phone, iPad, laptop may be used instead of the dice to set the rules of the game.

In another embodiment of the invention, the rules of the game may be changed in the middle of the play with every player consent to make the game more fun and enjoyable. For example, consider a scenario where the game is played by a family of two adults and two young kids, and the rules are set by the parents. If the older sibling wins the game, the parents can dynamically change the rule in the middle of the game and partner the two siblings together to avoid fights from breaking out. Alternatively, if the group-specific player are a group of millennials, then the players may change to rules to include drinking in the set of rules to be included in the middle of the game to make the game more fun and interesting. Alternatively, the drinking rules may be removed or modified, if the group-specific player are becoming blaring and intolerable.

In another embodiment of the invention, the game is ended when a player reaches the specific block on the grid predetermined by the group-specific players. Additionally, each block on the grid can hold a single player. For example, if the player rolls a number that lands them on another player's block they can skip over that block or keep skipping forward until they land on a free block. The same is true for if the action is to move the game piece backwards. Then the player will need to continue moving backwards until they reach an empty block.

Figure 4:
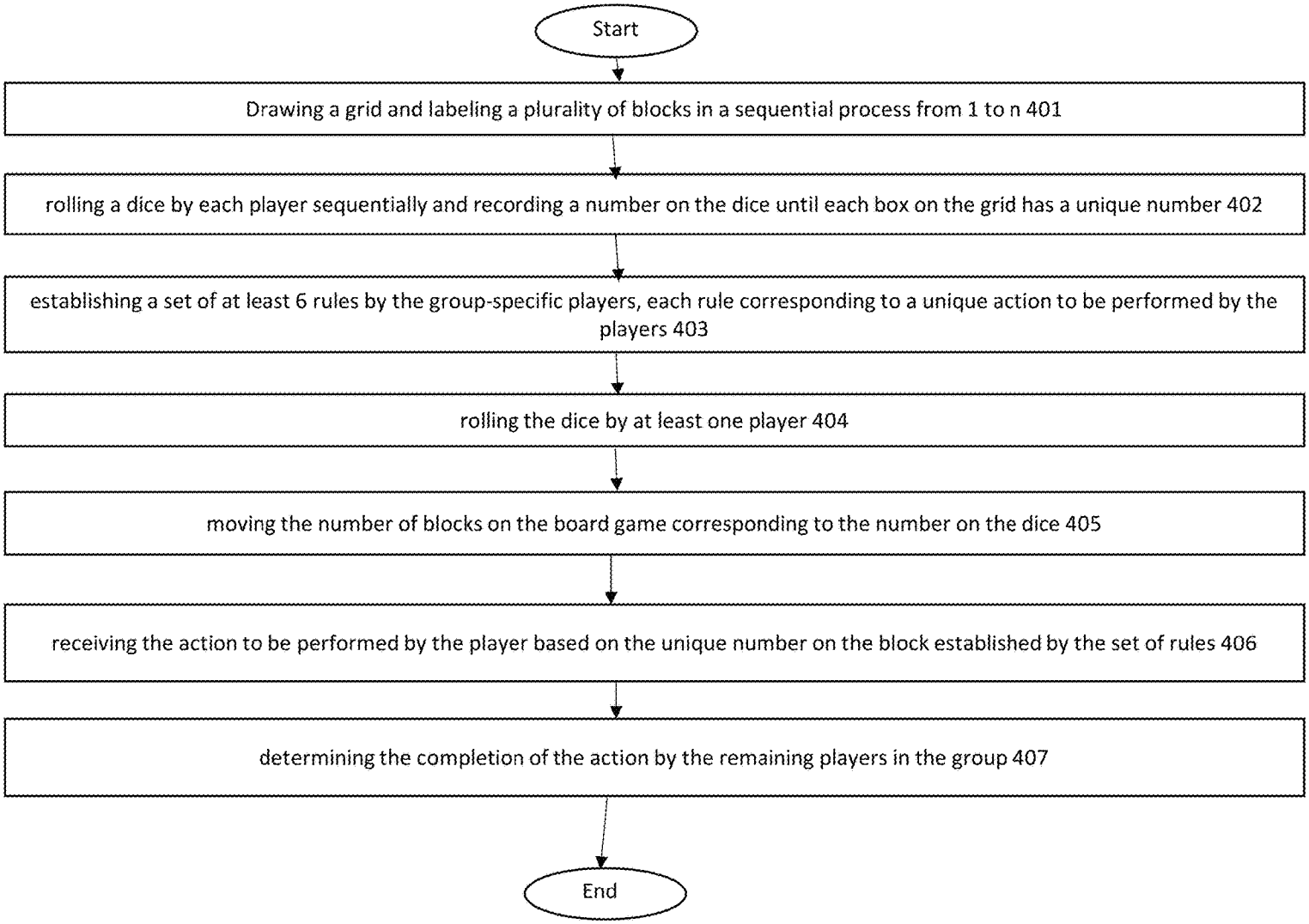
FIG. 4 shows method of playing the board game according to an aspect of the invention.

Now with reference to FIG. 4, in an embodiment of the invention the group-specific player board game comprises the steps of: drawing a grid and labeling a plurality of blocks in a sequential process from 1 to n, wherein n depends on the size of the grid 401, rolling a dice by each player sequentially and recording a number on the dice until each box on the grid has a unique number 402, establishing a set of at least 6 rules by the group-specific players, each rule corresponding to a unique action to be performed by the players 403, rolling the dice by at least one player 404, moving the number of blocks on the board game corresponding to the number on the dice 405, receiving the action to be performed by the player based on the unique number on the block established by the set of rules 406, determining the completion of the action by the remaining players in the group 407.

Further yet, in an embodiment of the invention, the determination of completion of the action performed by a player may be a consensus decision made by the group-specific players. Alternatively, the completion of the action by a player may be a consensus decision made by a majority of the group-specific players.

Figure 5:
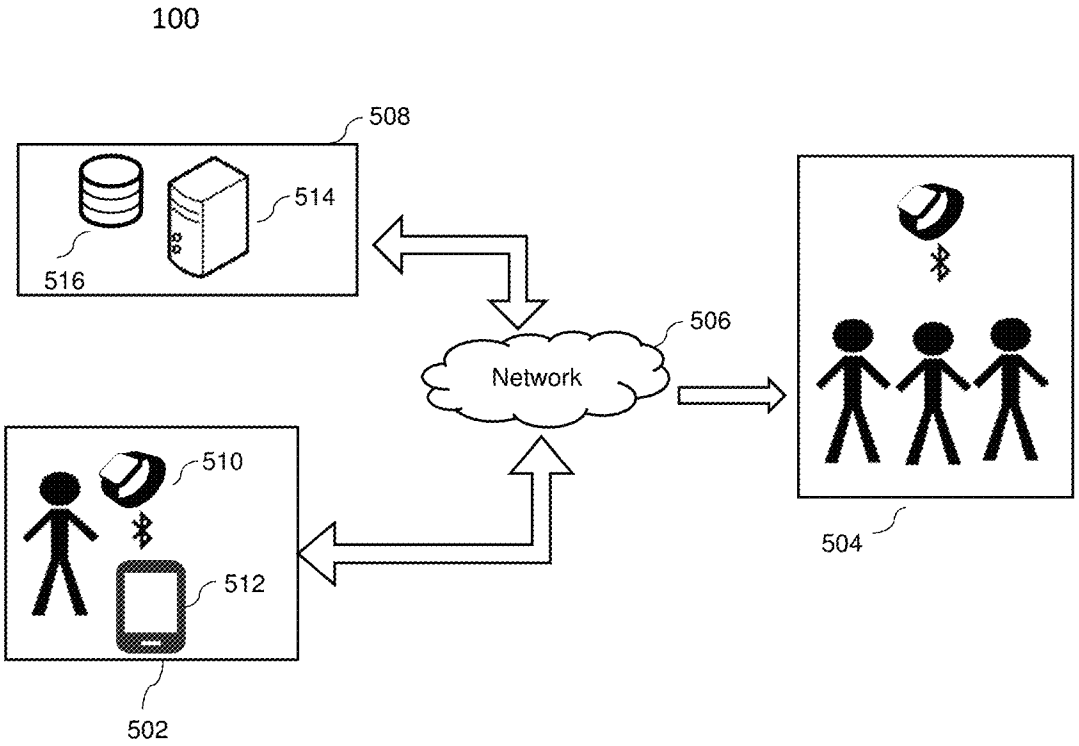
FIG. 5 illustrates an exemplary environment in which various embodiments of the disclosure can be practiced.

Now with reference to FIG. 5. In an embodiment of the invention, a dynamic board game playing system comprising of at least two players each with a body-worn/mobile device 510 configured for capturing of at least one action of the player, a dice wherein, each side of the dice demonstrates a number of moves on the board game, a processor 508, an analyzing module, a non-transitory storage element coupled to the processor 508, encoded instructions stored in the non-transitory storage element, wherein the encoded instructions when implemented by the processor 508, configure the system to draw a grid and label a plurality of blocks in a sequential process from 1 to n, wherein n depends on the size of the grid, roll the dice by each player sequentially and record a number on the dice until each box on the grid has a unique number, establish a set of at least 6 rules by the group-specific players, each rule corresponding to a unique action to be performed by the players, roll the dice by at least one player, move the number of blocks on the board game corresponding to the number on the dice, receive the action to be performed by the player based on the unique number on the grid established by the set of rules, determine the action performed by the player by mapping a received input action with a pre-stored set of actions via the analyzing module and dynamically interact with the group-specific players based on a completion of the action and indicate the completion of the action on the body-worn device.

Further yet, FIG. 5A dynamic board game playing system, said system comprising of: at least two players each with a body-worn/mobile device 510 configured for capturing of at least one action of the group-specific players 504, a dice (FIG. 1B) wherein, each side of the dice demonstrates a number of moves on the board game, a processor 508/(processing unit), an analyzing module, a non-transitory storage element coupled to the processor, encoded instructions stored in the non-transitory storage element, wherein the encoded instructions when implemented by the processor, configure the system to: draw a grid and label a plurality of blocks in a sequential process from 1 to n, wherein n depends on the size of the grid, roll the dice by each player sequentially and record a number on the dice until each box on the grid has a unique number, establish a set of at least 6 rules by the group-specific players, each rule corresponding to a unique action to be performed by the players, roll the dice by at least one player, move the number of blocks on the board game corresponding to the number on the dice, receive the action to be performed by the player based on the unique number on the grid established by the set of rules, determine the action performed by the player by mapping a received input action with a pre-stored set of actions via the analyzing module and dynamically interact with the player based on a completion of the action and indicate the completion of the action on the body-worn device.

FIG. 5 further illustrates an exemplary environment 500 in which various embodiments of the present invention can be practiced. The environment 500 includes player premises 502, group-specific players 504 and a processing unit 508. The player premises 502, group-specific players 504 and the processing unit 508 are communicatively coupled through a network 506. Typically, the processing unit 508 enables the group-specific players 504 to continuously monitor the actions performed by the player located in the player premises 502.

The processing unit 508 may either be operated by the player premises 502 or a third-party. Examples of the third party include, but are not limited to, a service provider that specializes in continuously collecting player action data from players and distributing the action data to a plurality of group-specific players. Typically, the processing unit 508 includes a processor 514 and an action performance information database 516.

The player premises 502 is a place, the player is located at or from where a player is playing a game for example, a player's home or a remote setting, an institution setting, game arcade, home, school etc. To enable continuous monitoring, the player uses a body worn device 510 and a mobile communication device 512. The body worn device 502 is typically embedded/equipped with one or more motion sensors, physiological sensors and environmental sensors. Examples of these sensors include, but are not limited to accelerometers, gyroscopes, inclinometers, geomagnetic sensors, global positioning systems, impact sensors, microphones, cameras, heart rate monitors, pulse oximeters, blood alcohol monitors, respiratory rate sensors, transdermal sensors, galvanic skin response (GSR) sensors and electromyography (EMG) sensors. In an embodiment of the present invention, the data captured by the one or more sensors is sent to the processing unit 508 through the network 506.

Typically, the body worn device 502 is worn on one or more body parts of the player, such as wrist, waist, neck, arm, leg, abdomen, chest, thigh, head, ear and fingers. Further, the body worn device 502 may be a wristband, a watch, an armband, a necklace, a headband, an earring, a waist belt and a ring.

The mobile communication device 514 is a portable device that has the capability of communicating over the network 506, presenting periodic action surveys to the player and receiving response from the player on the periodic action surveys. These periodic action surveys determine the physical, physiological or emotional actions performed by the players. The analyzing module uses the data from the periodic action surveys as well as data collected from the sensors to determine per-stored set of actions. Examples of the mobile communication device 514 include, but are not limited to, a smartphone, a tablet, a personal digital assistant (PDA) and a mobile phone.

In an embodiment of the present invention, the data captured by the one or more sensors of the body worn device 510 is first sent to the mobile communication device 512 and thereby, sent to the processing unit 508 over the network 506. The body worn device 510 communicates with the mobile communication device 512 over a short range wireless communication medium. Examples of the short range wireless communication medium include Bluetooth, ZigBee, Infrared, Near Field Communication (NFC) and Radio-frequency identification (RFID).

The network 506 may be any suitable wired network, wireless network, a combination of these or any other conventional network, without limiting the scope of the present invention. Few examples may include a LAN or wireless LAN connection, an Internet connection, a point-to-point connection, or other network connection and combinations thereof. The network 506 may be any other type of network that is capable of transmitting or receiving data to/from host computers, personal devices, telephones, video/image capturing devices, video/image servers, or any other electronic devices. Further, the network 506 is capable of transmitting/sending data between the mentioned devices. Additionally, the network 506 may be a local, regional, or global communication network, for example, an enterprise telecommunication network, the Internet, a global mobile communication network, or any combination of similar networks. The network 506 may be a combination of an enterprise network (or the Internet) and a cellular network, in which case, suitable systems and methods are employed to seamlessly communicate between the two networks. In such cases, a mobile switching gateway may be utilized to communicate with a computer network gateway to pass data between the two networks. The network 506 may include any software, hardware, or computer applications that can provide a medium to exchange signals or data in any of the formats known in the art, related art, or developed later.

In an embodiment of the present invention, the processing unit 508 receives the sensor data from the body worn device 510 and response on the periodic action surveys from the player performing the action. Thereby, the processing unit 508 correlates the sensor data with the response on periodic action surveys, generates reports corresponding to the actions performed by the player and sends the reports and other relevant data to the other group-specific players 504. These reports enable the other group-specific players 504 to track/monitor the progression of the completion of the action of the player. For example, according to the rule a player has to perform 15 jumping jacks. But the player only performed 14 jumping jacks. The group-specific players will be informed on their body worn devices based on the sensor data and the pre-determined set of actions obtained from the periodic action surveys that the player has not performed 15 jumping jacks and hence, not completed the task at hand.

In an embodiment of the present invention, the other group-specific players 504 are enabled to view the reports, as generated by the processing unit 508 using one or more devices selected from the group comprising of their own body-worn device, smartphone, a computer, a laptop, a tablet, a personal digital assistant (PDA) and a mobile phone.

Further yet, in an embodiment of the invention, the actions performed by the group-specific players are captured by one or more sensors selected from the group comprising a motion sensor, an accelerometer, a 3D accelerometer, a gyroscope, a global positioning system sensor (GPS), a magnetometer, an inclinometer and an impact sensor captured by the body worn device. Further yet, in an embodiment of the invention the input action performed by the group-specific players is at least one of, motion, gestural, visual, and audio.

Additionally, in an embodiment of the invention the interactive group-specific player system further comprising of, the sensor to detect at least one of, group-specific players' temperature, heart rate, pulse rate and respiratory patterns. Further yet, the group-specific player is alerted the completion of the action via at least one of, text, email, vibration with or without audible notification, visual display, and, or a color-coded or blinking notification. The system further comprising establishing a personal profile of the group-specific player based on at least one set of input actions.

In yet another embodiment of the invention, the completion of the task based on matching from the personal profile may be alerted to the group-specific players by, at least one of, a visual or color appearance, audio or sound, buzzer, vibration, fine motor skills, memory-based tasks, repeating actions, sounds or movements. Additionally, the matching from the personal profile of the group-specific player using machine learning algorithm. Further yet, in an embodiment of the invention the number of rules is established by the group-specific players at the beginning of the game.

The mobile communication device 512 is configured to present periodic action surveys to the players. The response of the players to questions of a periodic action survey determines another set of input action parameters. In an embodiment of the present invention, these input action parameters enable the other players in the group-specific players 504 to understand players's perception of changes in his/her motion characteristics such as fatigue, walking/running/movement impairment and weakness.

In an embodiment of the present invention, the mobile communication device 512 is configured to send the input action parameters to the processing unit 504 using the network 506. As described above, the input action parameters are determined by the response of the players to the questions of the periodic survey. In an embodiment of the present invention, the mobile communication device 512 is also configured to provide the input action parameters to the processing unit 504.

Figure 6:
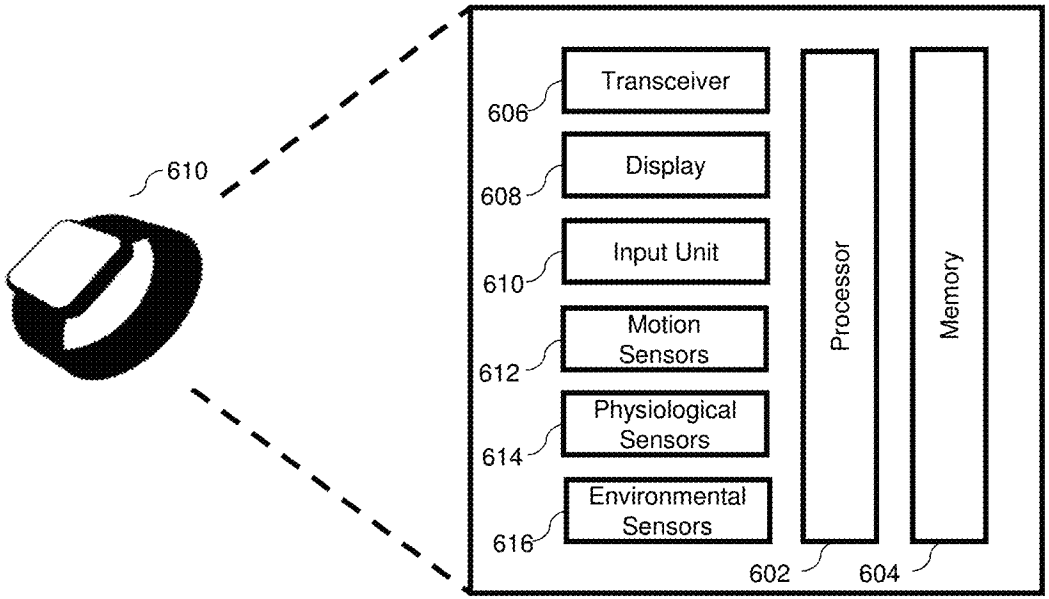
FIG. 6 illustrates an exemplary body worn device being used by a player, according to an embodiment of the disclosure.

FIG. 6 illustrates the exemplary body worn device 610 being used by the player, according to an embodiment of the disclosure. The body worn device 610 includes a processor 602, a memory 604, a transceiver 606, a display 608 and an input unit 610. The processor 602 executes a set of computer executable instructions stored in the memory 604 for providing the overall functionality of the body worn device 610. The processor 602 is further communicatively coupled to motion sensors 612, physiological sensors 614 and environmental sensors 616. In an embodiment of the present invention, the motion sensors 612 and the physiological sensors 612 continuously capture the action parameters that reflect motion characteristics and physiological characteristics of the player respectively.

The motion characteristics of the player include both activity related characteristics and motion related characteristics of the player. Examples of action parameters, captured by the motion sensors 612, corresponding to activity related characteristics of the player include, but are not limited to, maximum value of acceleration, minimum value of acceleration, time of acceleration, duration of acceleration, frequency of acceleration, gap between two maximum/minimum values of acceleration, rotational velocity, direction of acceleration, orientation, a stride cycle, a left/right step, a stride length, a walking speed, a stride interval, a gait variability, a stride-to-stride interval and a variability of stride length over time.

Examples of the motion sensors 612 include, but are not limited to, accelerometers, 3D accelerometers, gyroscopes, global positioning system (GPS), magnetometers, inclinometers and impact sensors.

Further, examples of action parameters, captured by the physiological sensors 614 include, but are not limited to, heart rate, pulse rate, respiratory rate and body temperature of the player.

The environmental sensors 616 of the body worn device 610 capture another set of parameters corresponding to the environmental data for the current location of the player. Examples of other parameters include, but are not limited to, temperature, humidity, air quality, pollen count, carbon dioxide levels and weather data.

In an embodiment of the present invention, the action parameters, as captured by the motion sensors 612 and the physiological sensors 614, are sent to the processing unit 608 over the network by the transceiver 606. In another embodiment of the present invention, all the action parameters, are sent to the processing unit 608 by the transceiver 606 over the network 606.

Going further, the display 608 is configured to display reminders and periodic action surveys/questionnaires to the player. The reminders may be related to the rules of the game or reminders for completing a pending periodic action survey. The periodic action survey may be related to the actions performed by the players including but not limited to, dancing, exercise, singing, eating, drinking, any physical, physiological performance. In an embodiment of the present invention, the player is enabled to report his/her actions and also, respond to the reminders and the periodic action surveys using the input unit 610. In an example, the input unit 610 is a set of one or more push buttons.

Figure 7:
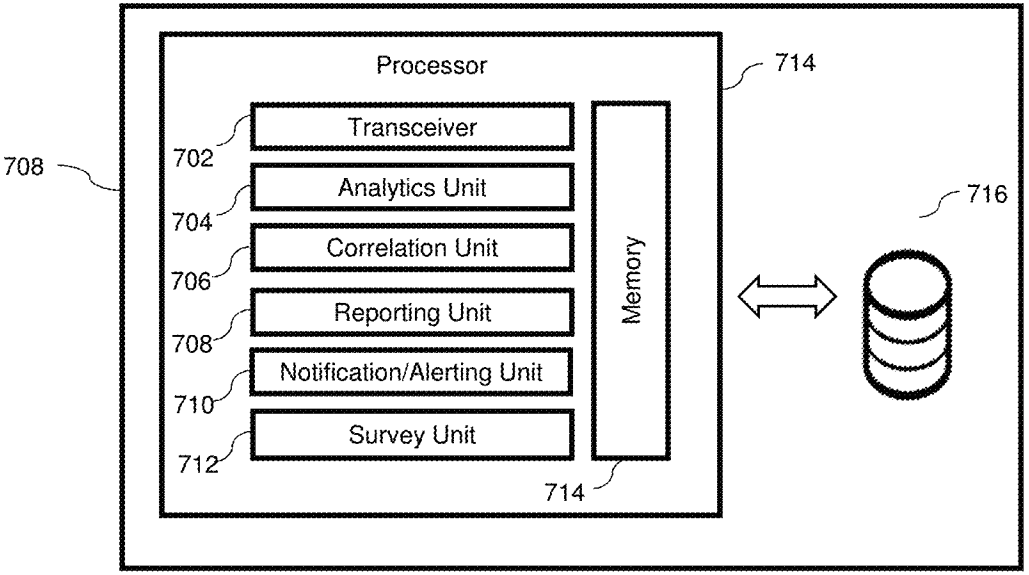
FIG. 7 illustrates an exemplary mobile communication device used for presenting a completion of an action by the player, according to an embodiment of the disclosure.

FIG. 7 illustrates the exemplary processing unit 708 used for monitoring the players for the performing and completion of action according to the rules set, according to an embodiment of the disclosure. As shown, the processing unit 708 includes the processor 714 and the action performance information database 716. The processor 714 is communicatively coupled to a transceiver 702, an analytics unit 704 and a correlation unit 706. The processor 714 is also communicatively coupled to the action performance information database 716 and a memory 714.

The transceiver 702 is configured to receive the action parameters from the body worn device 610. Also, the transceiver is further configured to receive the action parameters from at least one of the mobile communication device 512 and the body worn device 610. In an embodiment, the transceiver 702 is also configured to receive the input action parameters from at least one of the body worn device 610 and the mobile communication device 512.

Going further, the analytics unit 704 is configured to analyze the action parameters to compute and derive one or more metrics. The one or more metrics are computed using one or more analytical algorithms that are applied on action parameters, received continuously from the body worn device 610. In an example, the analytics unit 704 computes metrics corresponding to sustained activity (such as maximum/minimum number of steps in a continuous interval of time), peak activity (such as maximum mean step rate in a 5 minutes' time interval) and walking bouts (such as number of walking bouts, mean duration of walking bouts, mean number of steps in walking bouts and mean cadence of walking bouts) for the players. However, for a person skilled in the art it is understood that these examples are just for understanding purposes and the disclosure can be implemented for other metrics that may be computed based on the action parameters.

In an embodiment of the present invention, the analytics unit 704 is also configured to establish a personal motion signature of the players based on the action parameters. The personal motion signature reflects the normal activity and other related characteristics of the players. In yet another embodiment of the invention, the analytics unit may incorporate a fully automatic quality motion/emotion detector component which allows for an automatic detection of any emotional, physiological or physical motion/emotion for a more emotion/motion-based automated approach to computational movement—effectively integrating the idea into a more practical application imposing meaningful limits on practicing the idea.

The correlation unit 706 is configured to correlate another set of action parameters, as received from the players in response to the periodic action surveys, with at least one of the action parameters and the metrics, as computed by the analytics unit 704. In an example, the correlation unit 706 compares the input action parameters corresponding to the 12 Steps MS Walking Scale (MSWS-12) test with the action parameters corresponding to the motion characteristics and physiological characteristics of the players over a period of 10 min. This enables the group-specific players 504 to monitor the activity related characteristics and other related characteristics of the players and compare them with players' perception of changes in his/her motion characteristics such as fatigue, walking/running/movement impairment/motion and weakness.

In an embodiment of the present invention, the correlation unit 706 is also configured to correlate the action parameters with another set of action parameters. This enables group-specific players 504 to monitor the activity related characteristics and other related characteristics of the players and track how these characteristics change with changes in the environmental data.

In an embodiment of the present invention, the processor 714 also includes a reporting unit 708, a notification /alerting unit 710 and a survey unit 712. The reporting unit 708 is configured to generate reports for the players and provide these reports to the group-specific players 504 through the transceiver 702. The reports may be provided to the other players in the group at regular intervals (such as every 2-3 min), on-demand (when the group-specific players 504 requests for a report corresponding to the players), or when triggered by a rule. Typically, the rule may be defined by the group-specific players 504. An example of the rule is when the action parameters indicates that the players has not completed the action of performing 12 jumping jacks in a predefined interval of time.

In an embodiment of the present invention, a report, as generated by the reporting unit 708, includes data corresponding to at least one of the group comprising the action parameters, the another set of input action of parameters, the environmental parameters and the correlation between the action parameters and at least one of the input action parameters and the environmental parameters. In an embodiment of the present invention, the report also enables the group-specific players 504 to view the action history of the players, the one or more metrics as computed by the analytics unit 704 for the players, the current status (real-time) of the players in terms of the action parameters and the input action of parameters and the rule the player is performing, action history of the players, alerts/notifications corresponding to the players and generate more reports for the players. Further, the group-specific players 504 are also enabled to search for other players using the players monitoring tool.

The Notification/Alerting unit 710 is configured to generate reminders for the players. The reminders may be action reminders or reminders for completing a pending periodic action survey. In an embodiment of the present invention, the reminders are displayed to the players using the body worn device 510.

In an embodiment of the present invention, the Notification/Alerting unit 710 is also configured to send a notification to the players and/or the group-specific players 504 on detecting a deviation in the action parameters with respect to the personal motion signature of the players using machine learning algorithms. The notification may be a message, a phone call or any other communication means to instantly make the players and/or the group-specific players 504 aware of the deviation.

The survey unit 712 is configured to generate the periodic action surveys for the players and send them to the players using the transceiver 702. The survey unit 712 may also be configured to determine the questions to be included in the periodic action surveys and the frequency at which the periodic action surveys are presented to the players. In an embodiment, the group-specific players 504 may configure the survey unit 712 by defining the questions to be included in the periodic action surveys and the frequency of presenting these periodic action surveys to the players.

In an embodiment of the present invention, the processor 514 stores the action parameters, the input action parameters and the environmental parameters, as received by the transceiver 702, in the action information database 516. The action information database 516 is also used to store the profile of the players including information such as players ID number, age, gender, address, player condition, reports, the one or more metrics (as computed by the analytics unit 704), questions corresponding to the periodic surveys, frequency of presenting the periodic action surveys to the players, reports (as generated by the reporting unit 708) and the reminders/alerts.

In the drawings and specification, there have been disclosed exemplary embodiments of the disclosure. Although specific terms are employed, they are used in a generic and descriptive sense only and not for purposes of limitation, the scope of the invention being defined by the following claims. Those skilled in the art will recognize that the present invention admits of a number of modifications, within the spirit and scope of the inventive concepts, and that it may be applied in numerous applications, only some of which have been described herein. It is intended by the following claims to claim all such modifications and variations which fall within the true scope of the invention.

Embodiments described in the present disclosure can be implemented by any system having a processor and a non-transitory storage element coupled to the processor, with encoded instructions stored in the non-transitory storage element. The encoded instructions when implemented by the processor configure the system to continuously monitor the plurality of patients as discussed above in FIGS. 1-7. The systems shown in FIGS. 1-7 can practice all or part of the recited methods (FIGS. 6 and 7), can be a part of the recited systems, and/or can operate according to instructions in the non-transitory storage element. The non-transitory storage element can be accessed by a general purpose or special purpose computer, including the functional design of any special purpose processor. Few examples of such non-transitory storage element can include RAM, ROM, EEPROM, CD-ROM or other optical disk storage or other magnetic. The processor and non-transitory storage element (or memory) are known in the art, thus, any additional functional or structural details are not required for the purpose of the current disclosure.

Embodiments are described at least in part herein with reference to flowchart illustrations and/or block diagrams of methods, systems, and computer program products and data structures according to embodiments of the disclosure. It will be understood that each block of the illustrations, and combinations of blocks, can be implemented by computer program instructions. These computer program instructions may be provided to a processor of a general-purpose computer, special purpose computer, or other programmable data processing apparatus to produce a machine such that the instructions, which execute via the processor of the computer or other programmable data processing apparatus, create means for implementing the functions/acts specified in the block or blocks.

I claim:

1. A motion-sensed board game method, said method comprising the steps of:

providing a board displaying a grid with a plurality of blocks, each block labeled with an integer ranging from 1 to n, wherein each integer correlates with a specific rule demanding a unique physical action by at least a first player;

moving a game-piece of the first player by a number of blocks on the board game grid corresponding to a number on a die rolled by the first player;

determining the physical action to be performed by the first player based on the unique number appearing on the block landed on by the first player established by the specific rule;

determining the completion of the action by a non-transitory storage element coupled to a processor;

encoded instructions stored in the non-transitory storage element, wherein the encoded instructions when implemented by the processor, configure the system to perform the steps of:

determining the action performed by the first player by mapping a received motion data from a body-worn device worn by the first player performing the action requested with a pre-stored set of actions with motion data; and indicating the completion of the action by the first player upon the received motion data matching the pre-stored motion data on the body-worn device of the first player.

2. The method of claim 1, further comprising at least a second player with a second worn device indicating completion of the action by the first player.

3. The method of claim 1, wherein the first player is the youngest player in the group, with a subsequent roll performed by another player in a clockwise direction from the first player.

4. The method of claim 1, wherein labeling of the integer on the plurality of blocks in the grid is in at least one of, top-left to bottom-right, bottom-right to top-left, bottom-left to top-right, top-right to bottom-left direction.

5. The method of claim 1, wherein the rules may vary depending on at least one of age, gender, environment, physical and emotional abilities of the players.

6. The method of claim 1, wherein a player or players choose a specific block on the grid to determine the completion of the game.

7. The method of claim 6, wherein the game is ended when the player or players reach the specific block on the grid predetermined by the player or players.

8. The method of claim 1, wherein each block can hold a single player.

* * * * *